US008139010B2

(12) United States Patent
Shih et al.

(10) Patent No.: US 8,139,010 B2
(45) Date of Patent: Mar. 20, 2012

(54) GAMMA VOLTAGE GENERATOR AND CONTROL METHOD THEREOF AND LIQUID CRYSTAL DISPLAY DEVICE UTILIZING THE SAME

(75) Inventors: Hung-Min Shih, Changhua County (TW); Chung-Kuang Tsai, Jhudong Township, Hsinchu County (TW)

(73) Assignee: AU Optronics Corp., Hsinchu (TW)

( * ) Notice: Subject to any disclaimer, the term of this patent is extended or adjusted under 35 U.S.C. 154(b) by 1218 days.

(21) Appl. No.: 11/283,457

(22) Filed: Nov. 18, 2005

(65) Prior Publication Data

US 2006/0214895 A1 Sep. 28, 2006

(30) Foreign Application Priority Data

Mar. 23, 2005 (TW) ..... 94108926 A

(51) Int. Cl.
*G09G 3/36* (2006.01)

(52) U.S. Cl. ..... 345/89; 345/87; 345/88

(58) Field of Classification Search ..... 345/87–90, 345/204, 214, 76–77, 82–83
See application file for complete search history.

(56) References Cited

U.S. PATENT DOCUMENTS

| | | | | |
|---|---|---|---|---|
| 5,854,627 | A * | 12/1998 | Kurihara et al. | 345/211 |
| 6,731,259 | B2 * | 5/2004 | Yer et al. | 345/89 |
| 6,762,737 | B2 * | 7/2004 | Kajihara et al. | 345/89 |
| 7,006,114 | B2 * | 2/2006 | Sakaguchi | 345/690 |
| 7,030,840 | B2 * | 4/2006 | Mametsuka | 345/76 |
| 7,136,038 | B2 * | 11/2006 | Ha et al. | 345/89 |
| 7,187,375 | B2 * | 3/2007 | Ha et al. | 345/212 |
| 7,375,710 | B2 * | 5/2008 | Tobita | 345/89 |
| 2003/0030631 | A1 * | 2/2003 | Chen et al. | 345/211 |
| 2003/0201959 | A1 * | 10/2003 | Sakaguchi | 345/87 |
| 2004/0075674 | A1 * | 4/2004 | Bu | 345/690 |
| 2004/0113923 | A1 * | 6/2004 | Ha et al. | 345/690 |
| 2004/0124780 | A1 * | 7/2004 | Ha et al. | 315/169.3 |
| 2004/0125063 | A1 | 7/2004 | Lee et al. | |
| 2005/0062691 | A1 * | 3/2005 | Tamura et al. | 345/76 |
| 2005/0062736 | A1 * | 3/2005 | Ha et al. | 345/211 |
| 2005/0168418 | A1 * | 8/2005 | Seo et al. | 345/76 |

FOREIGN PATENT DOCUMENTS

| | | |
|---|---|---|
| CN | 1499472 | 5/2004 |
| CN | 1514274 | 7/2004 |

OTHER PUBLICATIONS

CN Office Action mailed Mar. 9, 2007.

* cited by examiner

*Primary Examiner* — Jason Mandeville
(74) *Attorney, Agent, or Firm* — Thomas|Kayden

(57) ABSTRACT

A gamma voltage generator can control brightness of a first color pixel unit and a second color pixel unit. A first potential divider is coupled between a first node and a second node for generating a first main gamma voltage. At least one second potential divider is coupled between the second node and a third node for generating a first sub-gamma voltage and a second sub-gamma voltage. The brightness of the first color pixel unit is controlled by the first main gamma voltage and the first sub-gamma voltage. The brightness of the second color pixel unit is controlled by the first main gamma voltage and the second sub-gamma voltage.

4 Claims, 13 Drawing Sheets

GAMMA VOLTAGE GENERATOR AND CONTROL METHOD THEREOF AND LIQUID CRYSTAL DISPLAY DEVICE UTILIZING THE SAME

BACKGROUND

The disclosure relates to a gamma voltage generator, and more particularly to a liquid crystal display (LCD) device comprising a gamma voltage generator.

A gamma voltage generator is used in active matrix liquid-crystal displays. The main function thereof is to provide a digital coded signal converter. With respect the characteristic curve of a liquid-crystal display, the input image data is adjusted properly along the curve. Through this conversion characteristic curve, the hue, gray level, contrast and color of the display can be adjusted.

FIG. 1*a* shows the relation of the voltages in a typical normally white mode liquid-crystal display (LCD) device to the display property (T) of a LCD device, where T is the transmittance. FIGS. 1*b* and 1*c* are a characteristic curve of image codes of a liquid-crystal display. To acquire the characteristic curve of FIGS. 1*b* and 1*c*, an adjusting mechanism is required for compensating the change of the property of the display due to external data input to the display. The adjusting mechanism is a gamma voltage generator. FIG. 1*d* shows a conversion curve of the data codes of the gamma voltage generator relative to the voltages.

In a Twisted-Nematic (TN) LCD, the characteristic curve of the transmittance of the liquid-crystal material to the voltage is a nonlinear curve. Therefore, in a gamma voltage generator, the greater the number of sampling nodes of the reference voltage, the smaller the approaching error of the characteristic curve can be obtained.

In the high resolution trend, for example, an 8-bit data driver can provide 256 gray levels, if an optimum adjustment to these 256 gray levels is desired, the adjustment is made through 256 externally provided reference voltage nodes. Further, the adjustment is performed one by one. However, the driving voltage of liquid-crystal material is alternative voltage, and therefore, each of the positive and negative polarities needs 256 reference voltages. Totally, 512 external input reference voltages are necessary for adjustment, but it is impractical to make so many inputs of the reference voltage in one driving IC. In fact, it is seldom to make such a work.

In general, only a few reference voltages are externally provided, and the driving IC, by a potential division method with a fixing ratio, the desired reference voltages are acquired by potential division without being provided externally. FIG. 2 is a schematic diagram of a conventional gamma voltage generator. A data driver of a LCD device generally requires a set of central symmetric gamma correction voltage. This central voltage is obtained from $V_{COM}=(V_{CC}+V_{GND})/2$. The input voltages $V_{CC}$ and $V_{GND}$ pass through a gamma voltage generator 20 for voltage division so as to obtain a plurality of voltages to control the brightness of display.

A panel of the LCD device comprises a plurality of pixels. Each pixel includes three color sub-pixel units for displaying primary colors, that is, red, green, and blue. Brightness of three color sub-pixel units are controlled by voltage output from gamma voltage generator 20. Since three color sub-pixel units included in a pixel are controlled by the same voltage, each color pixel unit cannot be individually controlled. Therefore, the color image cannot be optimally adjusted.

FIG. 3 is a schematic diagram of another conventional gamma voltage generator for solving the above problem.

Conventional gamma voltage generator 30 comprises resistor strings 32, 34, and 36. Resistor string 32 generates voltage to control the red color pixel. Resistor string 34 generates voltage to control the green color pixel. Resistor string 36 generates voltage to control the blue color pixel. Thus, the color image can be optimally calibrated as conventional gamma voltage generator 30 controls color pixel units. The sum of resistors of gamma voltage generator 30, however, is triple that of gamma voltage generator 20 such that cost and layout space of gamma voltage generator 30 are increased.

SUMMARY

Gamma voltage generators, control methods thereof and liquid crystal display devices utilizing the same are provided. An exemplary embodiment of a gamma voltage generator controls brightness of a first color pixel unit and a second color pixel unit, and comprises a first potential divider and at least one second potential divider. The first potential divider is coupled between a first node and a second node for generating a first main gamma voltage. The second potential divider is coupled between the second node and a third node for generating a first sub-gamma voltage and a second sub-gamma voltage. The brightness of the first color pixel unit is controlled by the first main gamma voltage and the first sub-gamma voltage. The brightness of the second color pixel unit is controlled by the first main gamma voltage and the second sub-gamma voltage.

An exemplary embodiment of a liquid crystal display device with gamma voltage generate comprises a display panel, a gate driver, and a data driver. The display panel comprises a first and a second color pixel units coupled to a data electrode and different gate electrodes. The gate driver outputs a plurality of scan signals to the corresponding gate electrodes. The data driver outputs a video signal to the data electrode for controlling brightness of the first color pixel unit and the second color pixel unit and comprises a first potential divider and at least one second potential divider. The first potential divider is coupled between a first node and a second node for generating a first main gamma voltage. The second potential divider is coupled between the second node and a third node for generating a first sub-gamma voltage and a second sub-gamma voltage. The brightness of the first color pixel unit is controlled by the first main gamma voltage and the first sub-gamma voltage. The brightness of the second color pixel unit is controlled by the first main gamma voltage and the second sub-gamma voltage.

Gamma voltage generator control methods of are also provided. An exemplary embodiment of a gamma voltage generator control method comprises controlling a liquid crystal display device comprising a display panel comprising a first color pixel unit coupled to a first data electrode and a first gate electrode, a second color pixel unit coupled to the first data electrode and a second gate electrode, and a gamma voltage generator comprising a first potential divider coupled between a first node and a second node for generating a first main gamma voltage and at least one second potential divider coupled between the second node and a third node for generating a first sub-gamma voltage and a second sub-gamma voltage and selecting a pixel unit. The first main gamma voltage or the first sub-gamma voltage is output for controlling brightness of the selected pixel unit when the selected pixel unit is the first color pixel unit. The first main gamma voltage or the second sub-gamma voltage is output for controlling brightness of the selected pixel unit when the selected pixel unit is the second color pixel unit.

BRIEF DESCRIPTION OF THE DRAWINGS

The invention can be more fully understood by reading the subsequent detailed description and examples with reference made to the accompanying drawings, wherein.

DETAILED DESCRIPTION

Figure 1A:
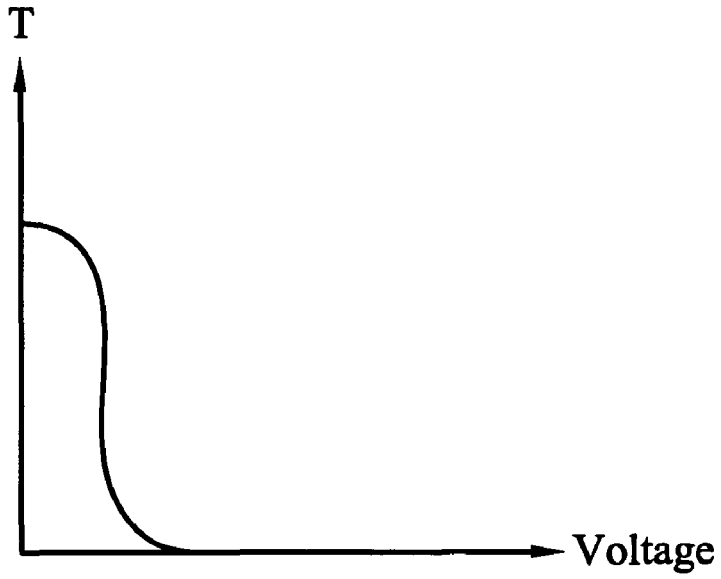
FIG. 1*a* shows the relation of the voltages in a general liquid-crystal display (LCD) device to the display property (Transimttance) of a LCD device.
Figure 1B:
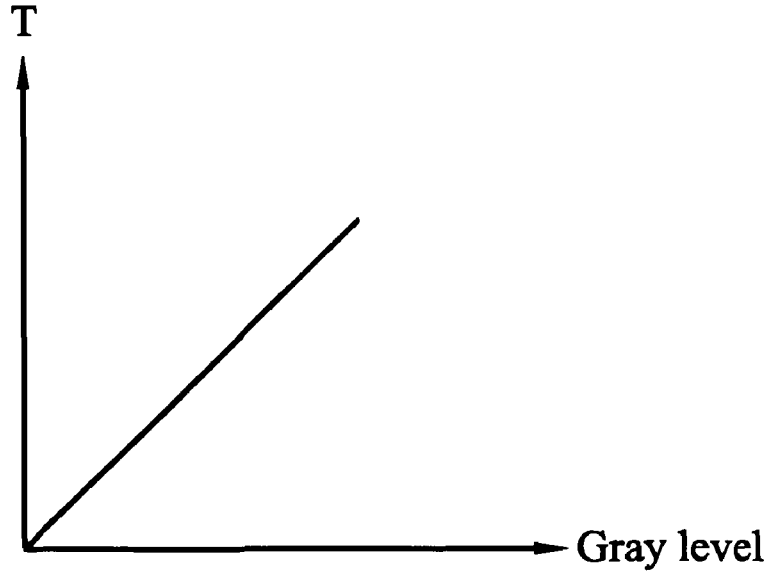
FIGS. 1*b* and 1*c* are a characteristic curve of image codes of liquid-crystal display.
Figure 1C:
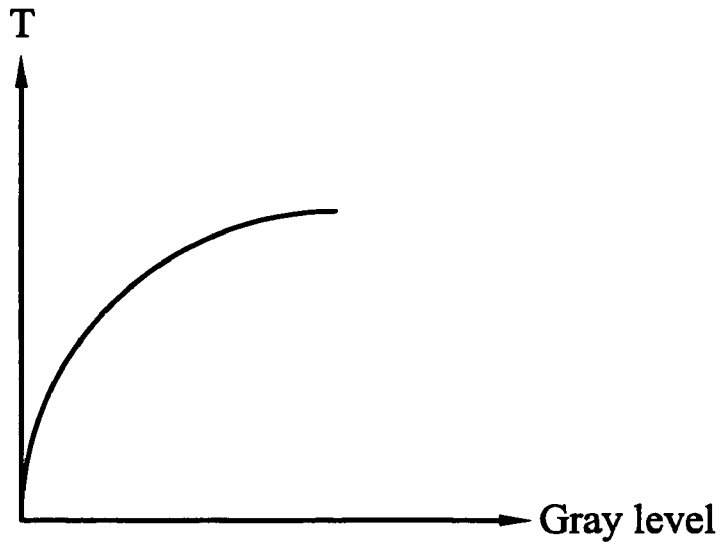
Figure 1D:
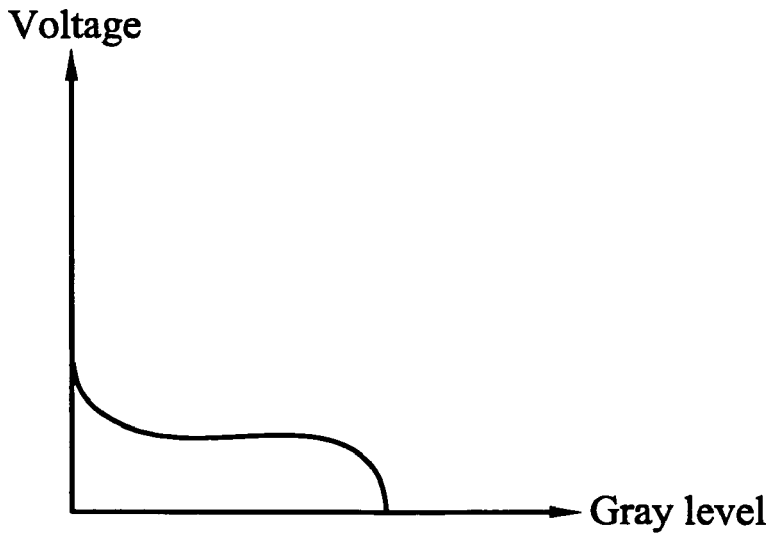
FIG. 1*d* shows a conversional curve resistor string in the data driver.
Figure 2:
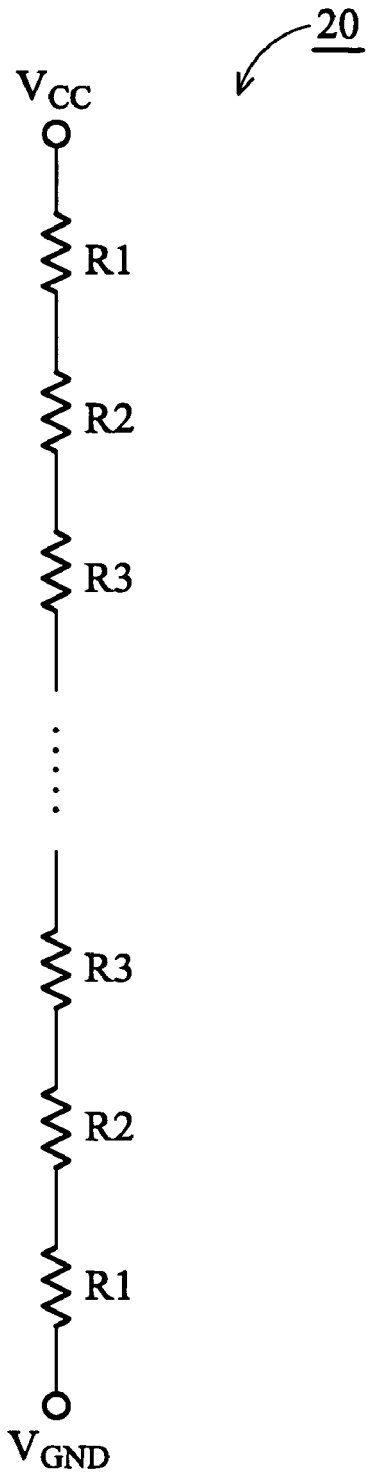
FIG. 2 (RELATED ART)
FIG. 2 is a schematic diagram of conventional gamma voltage generator.
Figure 3:
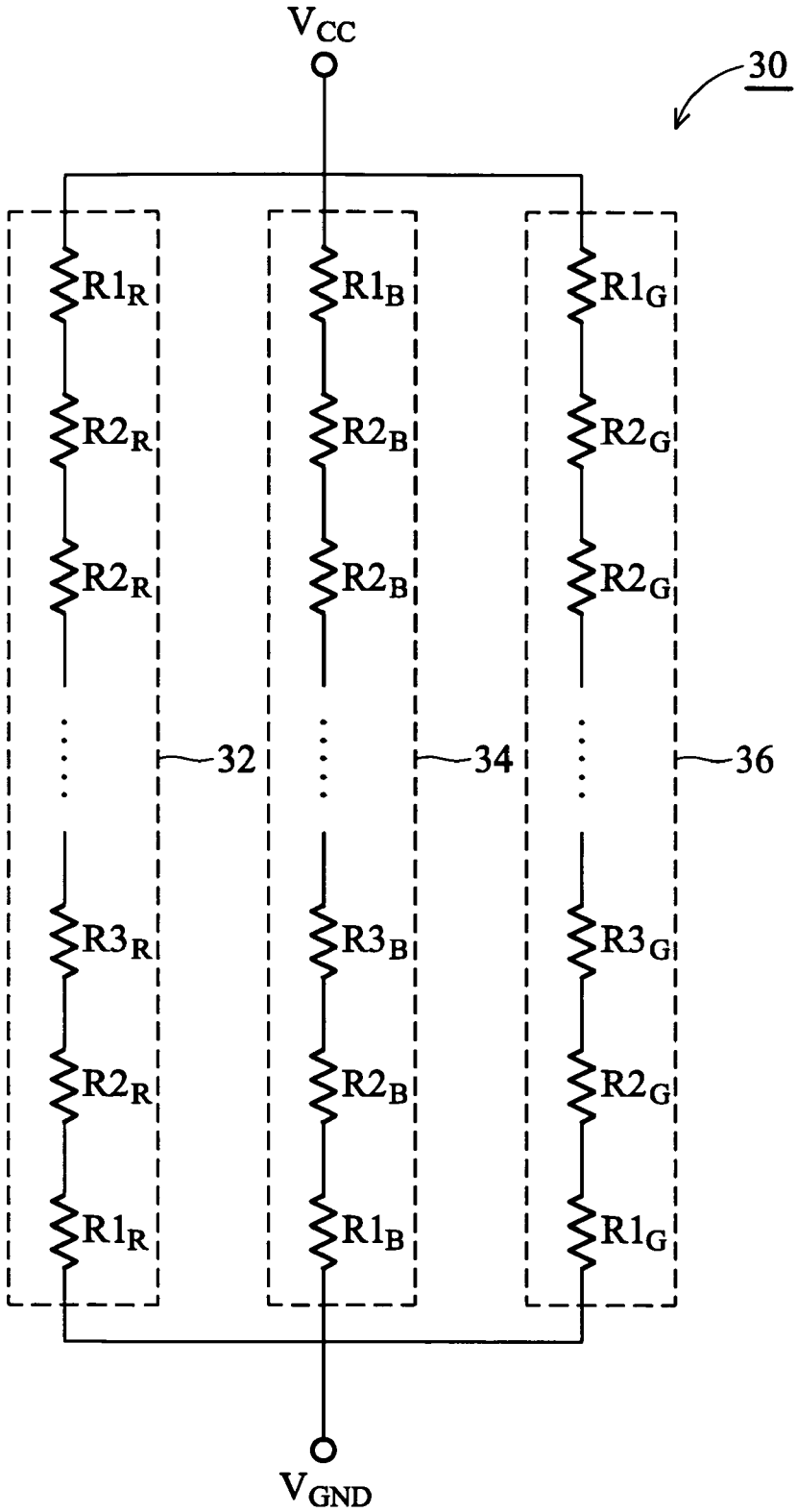
FIG. 3 (RELATED ART)
FIG. 3 is a schematic diagram of another conventional gamma voltage generator.
Figure 4A:
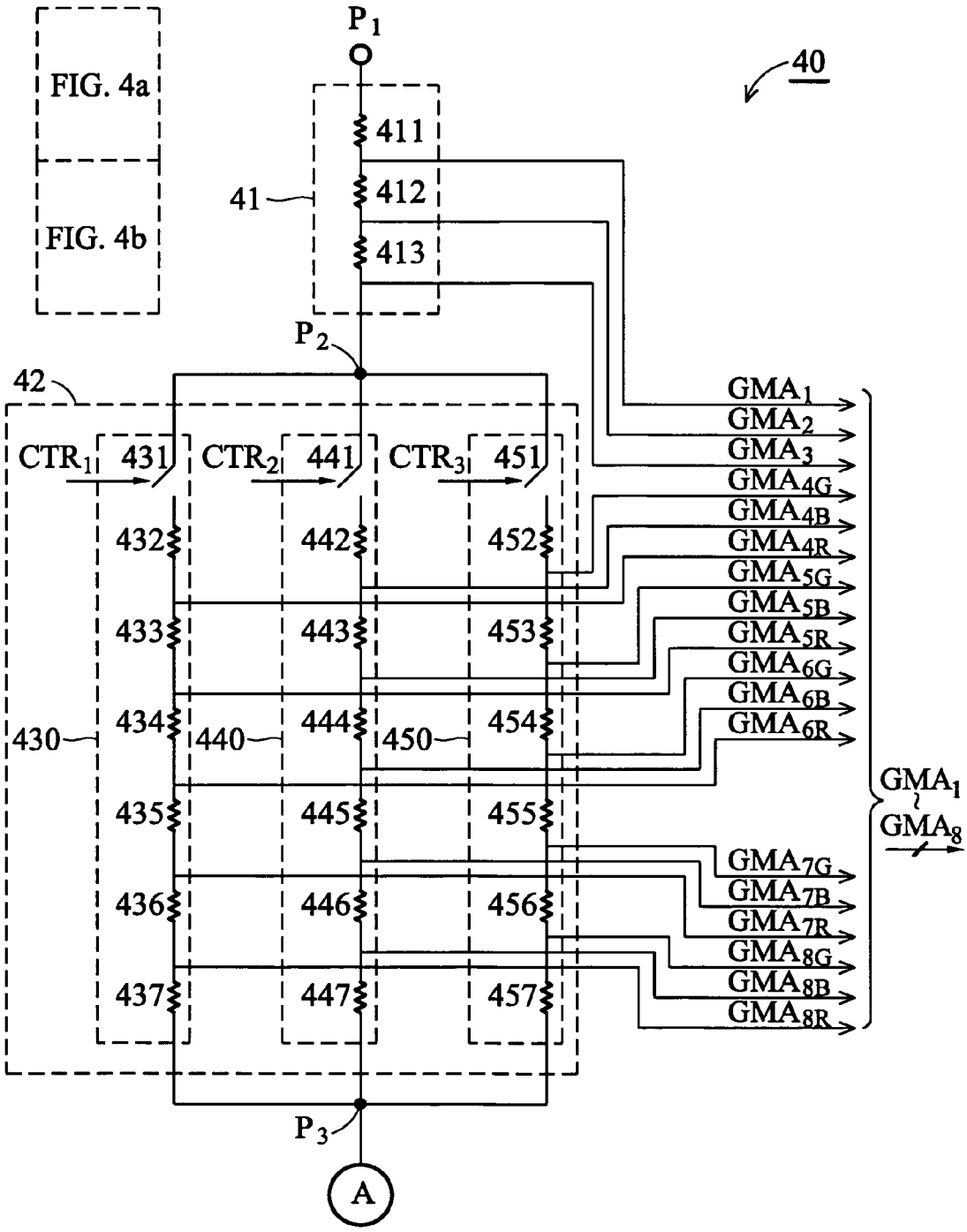
FIGS. 4*a* and 4*b* are schematic diagrams of an embodiment of a RGB independent gamma voltage generator.
Figure 4B:
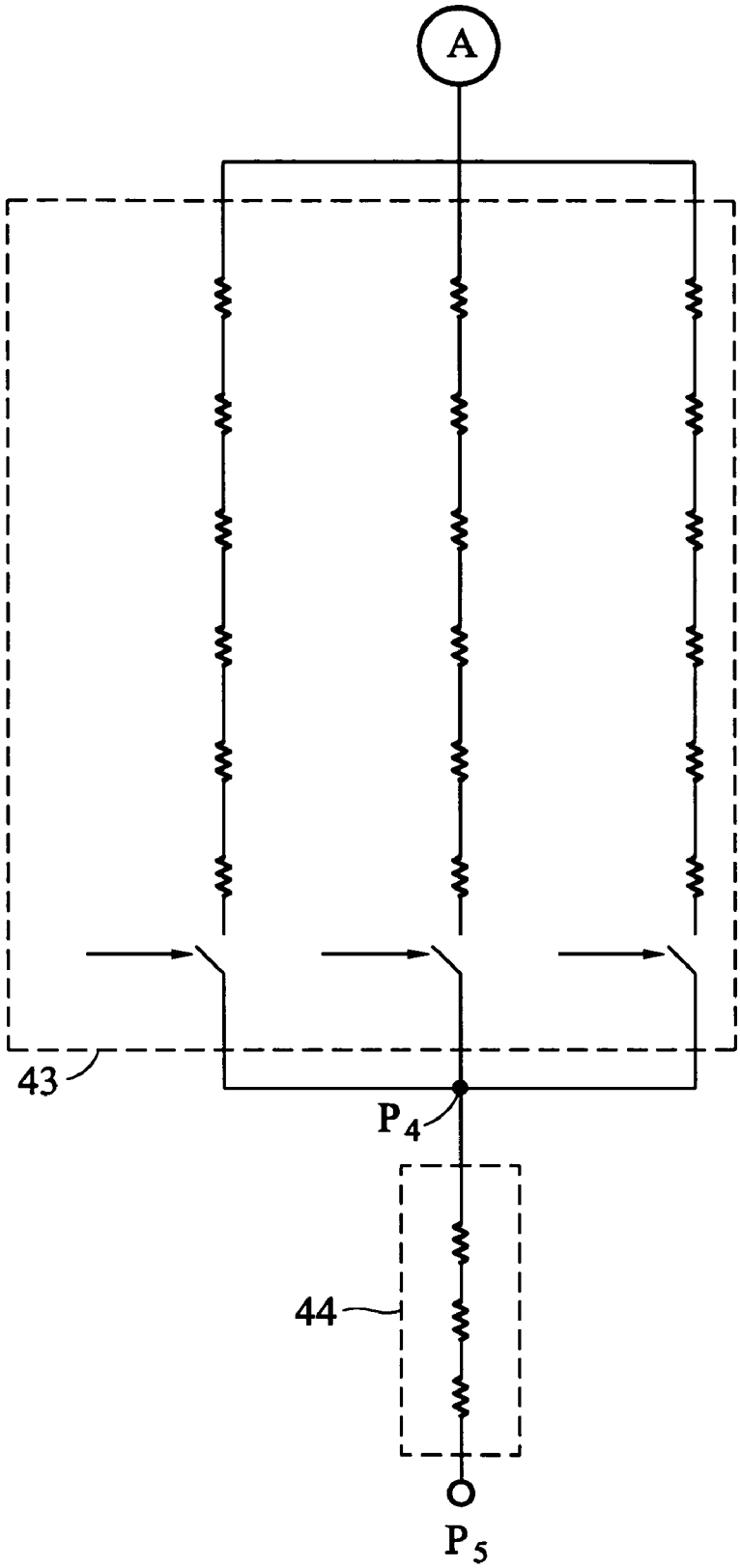

FIGS. 4*a* and 4*b* are schematic diagrams of an embodiment of RGB independent gamma voltage generator. Gamma voltage generator 40 comprises potential dividers 41~44. Potential divider 41 is coupled between node $P_1$ and node $P_2$. Potential divider 42 is coupled between node $P_2$ and node $P_3$. Potential divider 43 is coupled between node $P_3$ and node $P_4$. Potential divider 44 is coupled between node $P_4$ and node $P_5$.

Potential dividers 41 and 44 generate two main groups of gamma voltages with the same magnitude but opposite polarities for representing high gray levels. Since the structure of potential dividers 41 and 44 are the same, only potential divider 41 is given as an example.

Potential dividers 42 and 43 generate two groups of sub-gamma voltages with the same magnitude but opposite polarities for representing middle or low gray levels. Since the structure of potential dividers 42 and 43 are the same, only potential divider 42 is given as an example.

Potential dividers 41 and 42 can be formed by other elements, but resistors are given as an example of potential dividers 41 and 42. In this embodiment, potential divider 41 is formed by resistors 411~413 connected in serial. Main gamma voltage $GMA_1$ is generated by a connection node between resistor 411 and resistor 412, main gamma voltage $GMA_2$ is generated by a connection node between resistor 412 and resistor 413, main gamma voltage $GMA_3$ is generated by a connection node between resistor 411 and potential divider 42.

Main gamma voltages $GMA_1$~$GMA_3$ represent high gray levels. When a pixel module comprising three color pixel units displays high gray level, the color pixel units receive the same main gamma voltage, wherein the color pixel units respectively display red, blue, and, green.

Potential divider 42 comprises sub-potential dividers 430~450 connected in parallel. Sub-potential divider 430 is constituted by a switch 431 and resistors 432~437 connected with switch 431 in serial. The switch 431 is turned on or off by a control signal $CTR_1$. When node $P_1$ and node $P_4$ respectively receive voltage $V_1$ and voltage $V_2$ and switch 431 is turned on, connection nodes between resistors 432~437 will generate sub-gamma voltages $GMA_{4R}$~$GMA_{8R}$.

Sub-potential divider 440 is constituted by a switch 441 and resistors 442~447 connected with switch 441 in serial. The switch 441 is turned on or off by a control signal $CTR_2$. When node $P_1$ and node $P_4$ respectively receive voltage $V_1$ and voltage $V_2$, and switch 441 is turned on, connection nodes between resistors 442~447 will generate sub-gamma voltages $GMA_{4B}$~$GMA_{8B}$.

Sub-potential divider 450 is constituted by a switch 451 controlled by a control signal $CTR_3$ and resistors 452~457 connected with switch 451 in serial. When node $P_1$ and node $P_4$ respectively receive voltage $V_1$ and voltage $V_2$, and switch 451 is turned on, connection nodes between resistors 452~457 will generate sub-gamma voltages $GMA_{4G}$~$GMA_{8G}$.

Switches 431, 441, and 451 can be turned on by control signals $CTR_1$~$CTR_3$ at the same time. Sub-gamma voltages output from potential divider 42 represent middle or low gray levels. When a pixel module comprising three color pixel units respectively displaying red, blue, and green displays middle or low gray levels, brightness of the color pixel unit displaying red is controlled by sub-gamma voltages $GMA_{4R}$~$GMA_{8R}$, brightness of the color pixel unit displaying blue is controlled by sub-gamma voltages $GMA_{4B}$~$GMA_{8B}$, and brightness of the color pixel unit displaying green is controlled by sub-gamma voltages $GMA_{4G}$~$GMA_{8G}$. Additionally, a plurality of potential dividers 42 can be connected in parallel. Different potential dividers have different impedance for generating different sub-gamma voltages.

Figure 5:
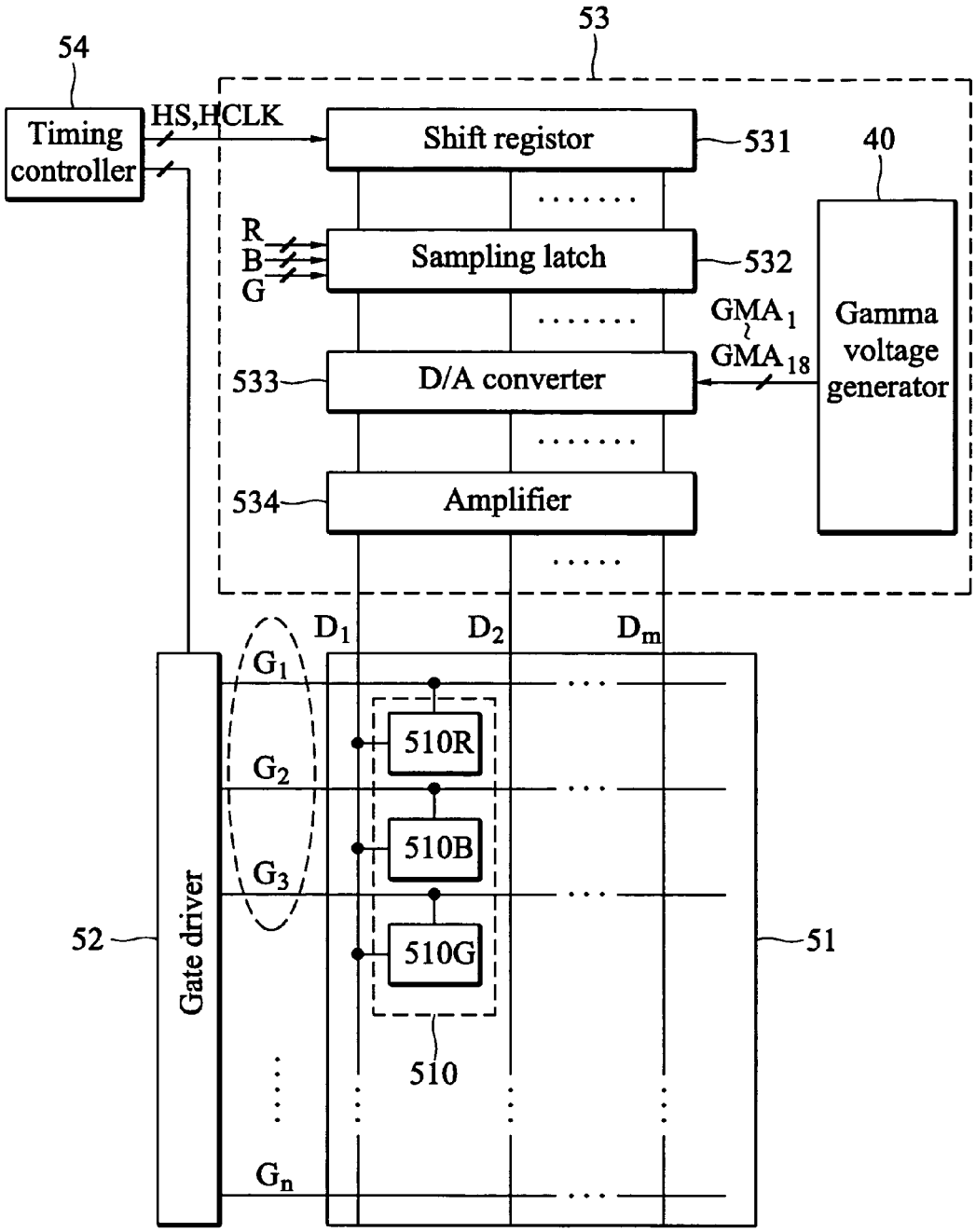
FIG. 5 is a block diagram of an embodiment a LCD device.

FIG. 5 is a block diagram of an embodiment of a LCD device. The LCD device comprises a display panel 51, a gate driver 52, a data driver 53, and a timing controller 54. Display panel 51 comprises interlacing data electrodes $D_1$~$D_m$ and gate electrodes $G_1$~$G_n$. Each of the interlacing data electrodes and gate electrodes controls a pixel module including three color pixel units respectively displaying red, blue, and green.

As color pixel units are arranged and shown in FIG. 5, each gate electrode has corresponding gate electrodes. Taking pixel module 510 as an example, color pixel unit 510R is controlled by data electrode $D_1$ and sub-gate electrode $G_1$, color pixel unit 510B is controlled by data electrode $D_1$ and sub-gate electrode $G_2$, and color pixel unit 510G is controlled by data electrode $D_1$ and sub-gate electrode $G_3$.

Gate driver 52 is controlled by timing controller 54 for outputting scan signals and turning all color pixel units at the same row on or off through gate electrodes $G_1$~$G_n$.

Data driver 53 comprises a shift register 531, a sampling latch 532, a digital-to-analog (D/A) converter 54, an amplifier 534, and a gamma voltage generator 40. When a gate electrode is selected, timing controller 54 outputs a horizontal synchronizing signal HS and a clock signal HCLK to shift register 531. Shift register 531 shifts the horizontal synchronizing signal HS regarding a latch clock through the clock signal HCLK and outputs the latch clock to sampling latch 532.

Sampling latch 532 samples the image signals R, B, and G supplied to data electrodes $D_1$~$D_m$ and latches the sampled image signals R, B, and G according to the latch clock.

D/A converter 533 receives the latched image signals R, B, and G and obtains gamma voltages output from gamma voltage generator 40 for converting the latched image signals R, B, and G to analog signals, wherein the obtained gamma voltages correspond to the latched image signals R, B, and G.

Amplifier 534 amplifies the converted image signals R, B, and G and outputs the amplified image signals to the corresponding data electrodes for controlling brightness of the corresponding color pixel unit.

Since data driver 53 comprises gamma voltage generator 40 shown in FIGS. 4*a* and 4*b*, as pixel module 510 desires to display middle or low gray levels, gamma voltage generator 40 respectively supplies different gamma voltages to color pixel units 510R, 510B, and 510G included in pixel module 510 for displaying different brightness. When pixel module 510 desires to display high gray level, gamma voltage generator 40 supplies a single gamma voltage to color pixel units 510R, 510B, and 510G included in pixel module 510 for displaying the same brightness.

With reference to FIGS. 4*a* and 4*b* and using pixel module 510 as an example, a control method of a LCD is described as follows.

First, a color pixel unit is selected. When color pixel unit 510R included in pixel module 510 is selected, gamma voltage generator 40 outputs main gamma voltages $GMA_1$~$GMA_3$ or outputs sub-gamma voltages $GMA_{4R}$~$GMA_{8R}$ to color pixel unit 510R for controlling brightness of color pixel unit 510R.

As color pixel unit 510G included in pixel module 510 is selected, gamma voltage generator 40 outputs main gamma voltages $GMA_1$~$GMA_3$ or outputs sub-gamma voltages $GMA_{4G}$~$GMA_{8G}$ to color pixel unit 510G for controlling brightness of color pixel unit 510G.

As color pixel unit 510B included in pixel module 510 is selected, gamma voltage generator 40 outputs gamma voltages $GMA_1$~$GMA_3$ or outputs sub-gamma voltages $GMA_{4B}$~$GMA_{8B}$ to color pixel unit 510B for controlling brightness of color pixel unit 510B.

Figure 6:
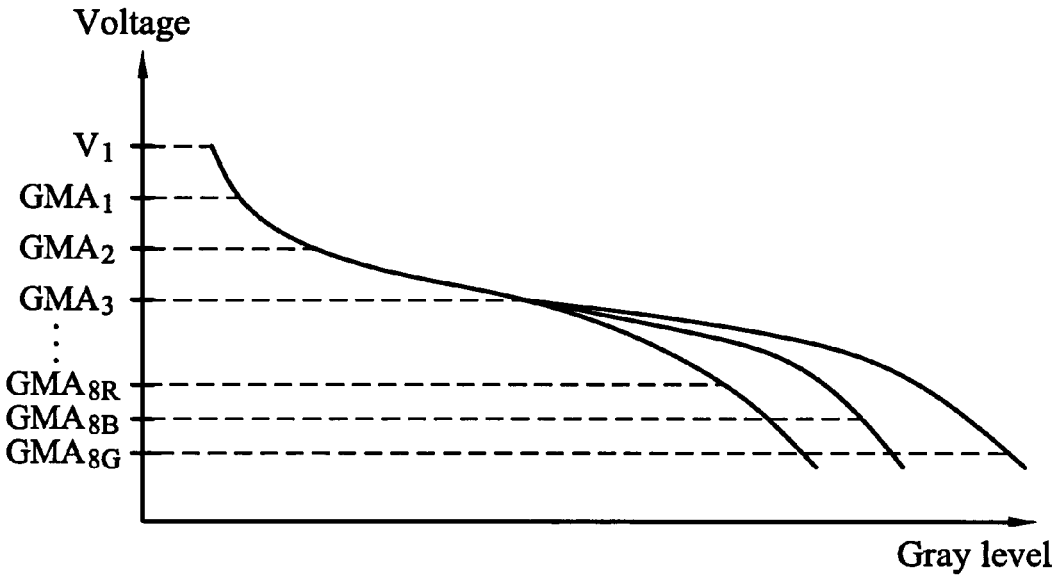
FIG. 6 is a transfer curve of gamma voltage generator setting in data driver.

FIG. 6 is a transformation curve of gamma voltage generator 40. Assuming node $P_1$ and node $P_3$ respectively receive power signal $V_1$ and power signal $V_2$ and switches 431, 441, and 451 are turned on, the transformation curve shown in FIG. 6 can be obtained.

Figure 7A:
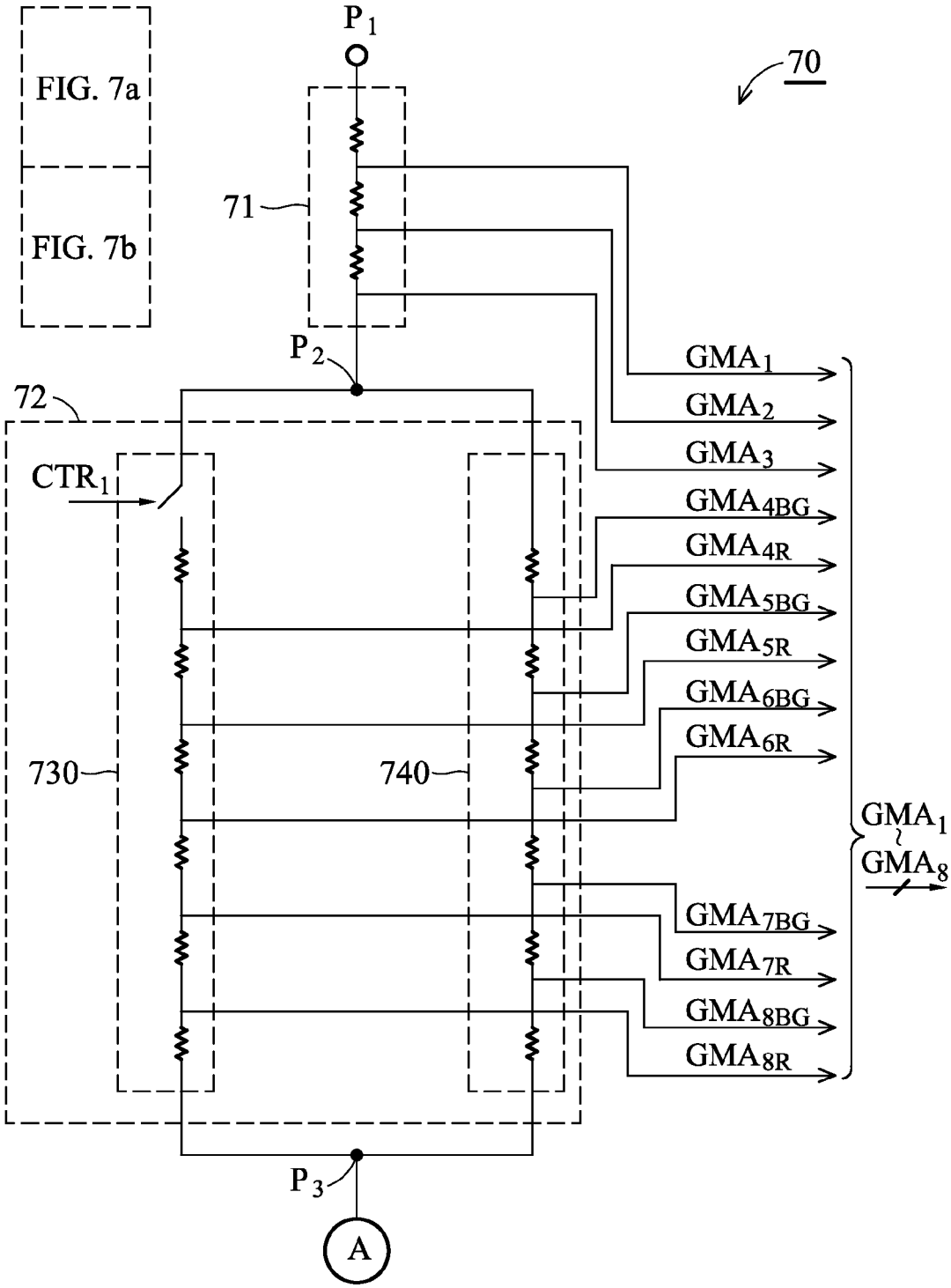
FIGS. 7*a* and 7*b* are schematic diagrams of an embodiment of a RGB independent gamma voltage generator.
Figure 7B:
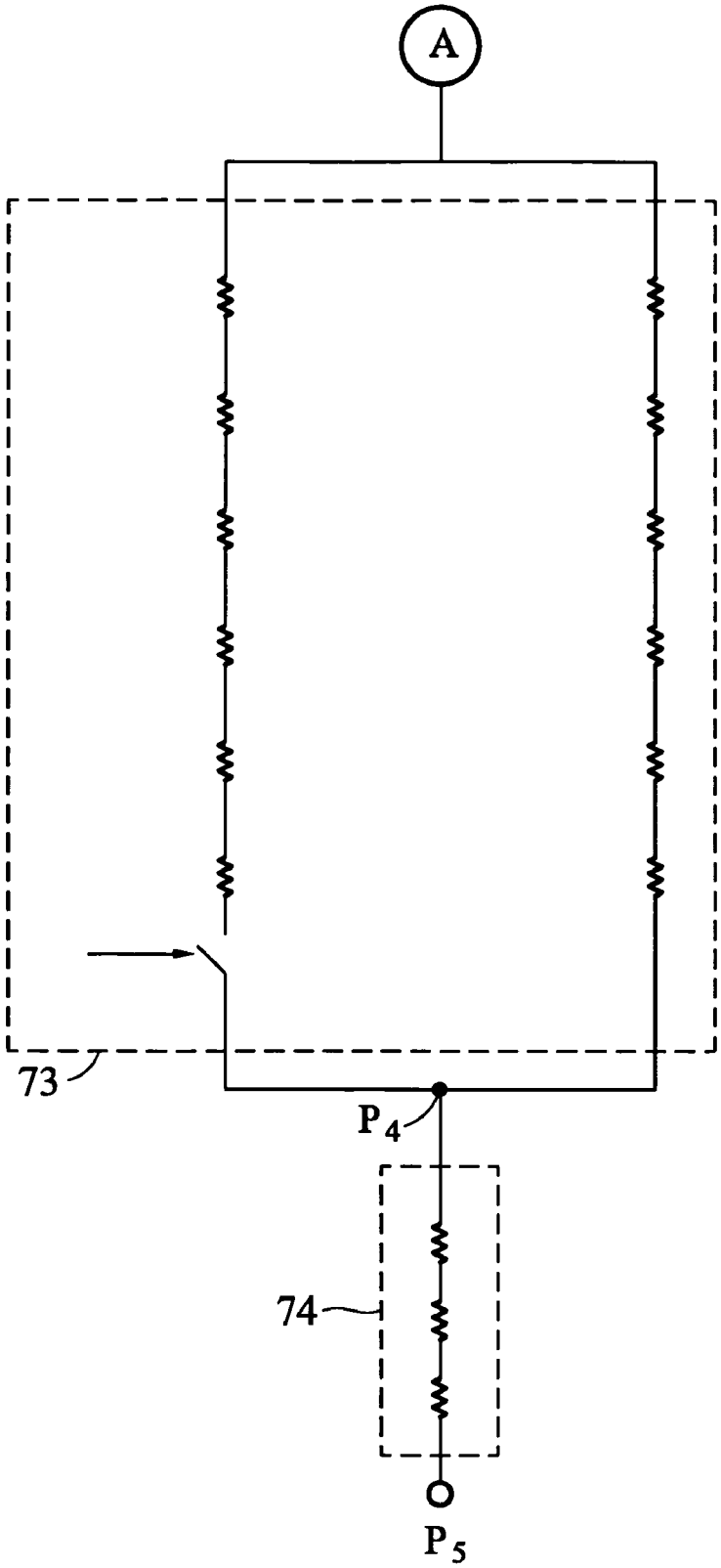

FIGS. 7*a* and 7*b* are schematic diagrams of an embodiment of a gamma voltage generator according to an embodiment of the invention. Gamma voltage generator 70 is similar to that shown in FIGS. 4*a* and 4*b* except that gamma voltage generator 70 utilizes sub-potential dividers 730 and 740 to generate sub-gamma voltages to color pixel units for respectively displaying red, blue, and green.

In this embodiment, sub-gamma voltages $GMA_{4R}$~$GMA_{8R}$ are output from potential divider 730 to control brightness of a color pixel unit displaying red and sub-gamma voltages $GMA_{4BG}$~$GMA_{8BG}$ output form potential divider 740 to control brightness of two color pixel units respectively displaying blue and green.

Additionally, a switch of potential divider 730 determines whether to generate sub-gamma voltages $GMA_{4R}$~$GMA_{8R}$ according to control signal $CTR_1$. When the switch of potential divider 730 is turned off, potential divider 730 cannot output sub-gamma voltages $GMA_{4R}$~$GMA_{8R}$ to control brightness of a color pixel unit displaying red. Since potential divider 740 does not comprise a switch, as node $P_1$ and node $P_4$ receives power signals, sub-gamma voltages $GMA_{4BG}$~$GMA_{8BG}$ can be generated.

Figure 8:
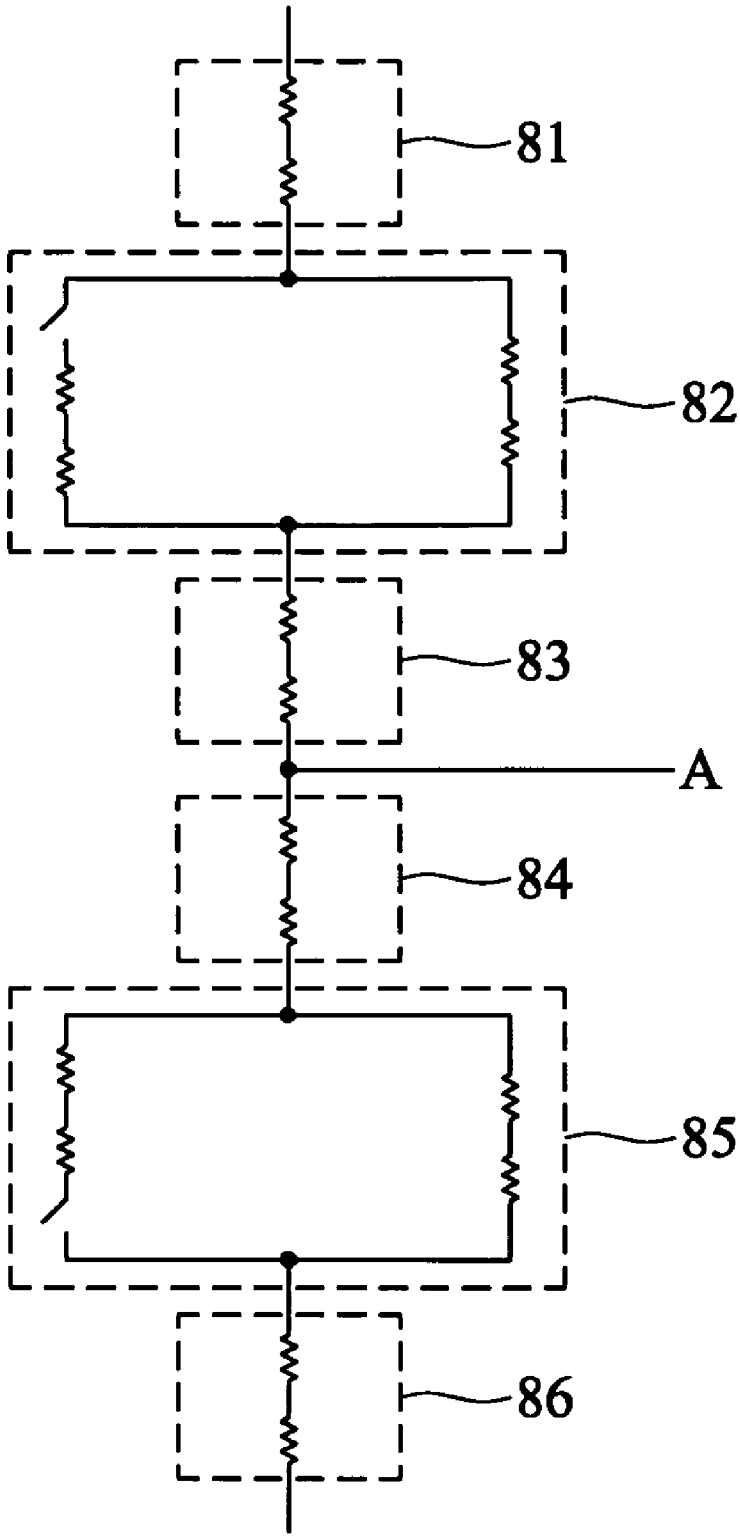
FIGS. 8~10 are schematic diagrams of an embodiment of a RGB independent gamma voltage generator.
Figure 9:
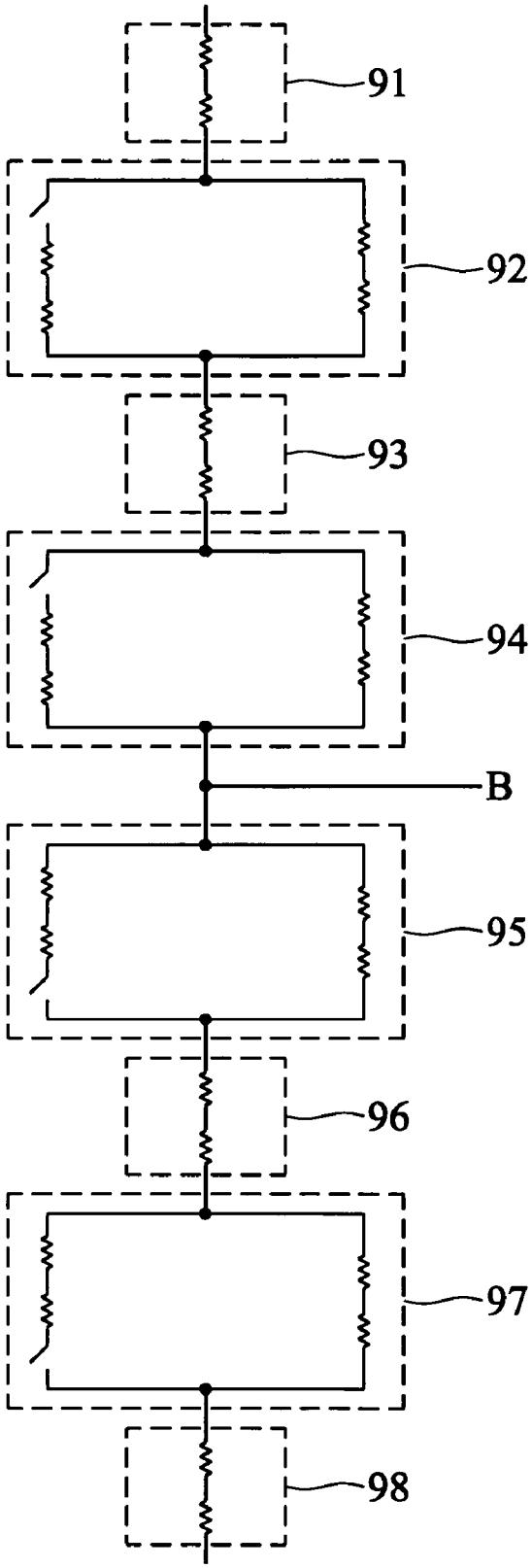
Figure 10:
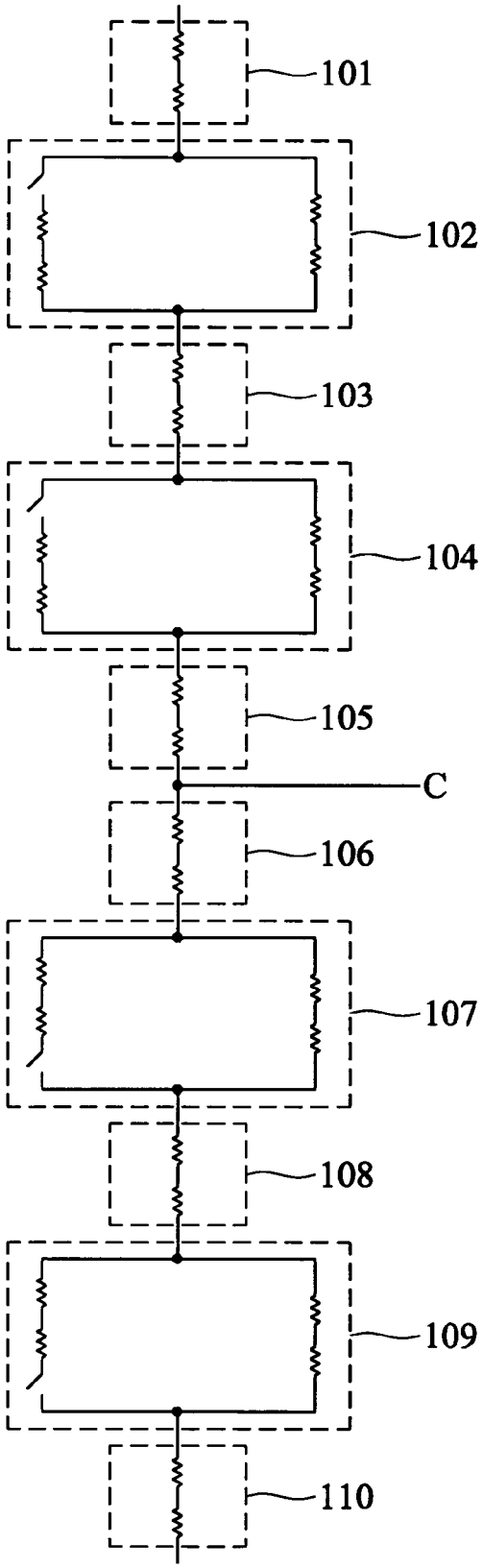

The arrangement method of the potential divider in the gamma voltage generator is not limited to the disclosed. FIGS. 8~10 are schematic diagrams of other embodiments of a gamma voltage generator. In FIGS. 8~10, each potential divider is formed by two resistors.

As shown in FIG. 8, node A is a mirror node. First gamma voltages output from potential dividers 81~83 above node A and second gamma voltages output from potential dividers 84~86 below node A have the same magnitude but opposite polarities.

As shown in FIG. 9, node B is a mirror node. First gamma voltages output from potential dividers 91~94 above node B and second gamma voltages output from potential dividers 95~98 below node B have the same magnitude but opposite polarities in LCD driving.

As shown in FIG. 10, node C is a mirror node. First gamma voltages output from potential dividers 101~105 above node C and second gamma voltages output from potential dividers 106~110 below node C have the same magnitude but opposite polarities in LCD driving.

Advantages of embodiments of the invention are summarized in the following.

One of the gamma voltage generators according to the invention can supply different gamma voltages to color pixel units to display high gray levels and a single gamma voltage to the color pixel units to display low gray levels, wherein the color pixel units respectively display red, blue, and green and are included in a pixel module. Thus, the gamma voltage generators increase LCD quality but do not substantially increase cost.

Additionally, the gamma voltage generator can supply different gamma voltages to the color pixel units for displaying a low gray level and supply a single gamma voltage to the color pixel units for displaying a high gray level.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A gamma voltage generator controlling brightness of a first color pixel unit for generating a first primary color, a second color pixel unit for generating a second primary color and a third color pixel unit for generating a third primary color, wherein the first, second, and third primary colors are mutually different from each other, the gamma voltage generator comprising:

a first potential divider comprising a first plurality of resistors connected in series and coupled between a first node and a second node for receiving a reference voltage and generating a first main gamma voltage, wherein the brightness of the first color pixel unit, the second color pixel unit and the third color pixel unit are all controlled by the first main gamma voltage, when the first color pixel unit, the second color pixel unit and the third color pixel unit are to be driven with a brightness corresponding to a high gray level relative to a maximum gray level; and at least one second potential divider coupled in series with the first potential divider between the second node and a third node for generating a first sub-gamma voltage and a second sub-gamma voltage, wherein the second potential divider comprises:

a first sub-potential divider comprising a second plurality of resistors connected in series, being coupled between the second node and the third node for generating the first sub-gamma voltage to both the first color pixel unit and the third color pixel unit; and a second sub-potential divider coupled in parallel with the first sub-potential divider between the second node and the third node for generating the second sub-gamma voltage to the second color pixel unit, the second sub-potential divider comprising:

a third plurality of resistors connected in series; and a switch coupled in series to the third plurality of resistors and controlled by a control signal for determining whether to activate the second sub-potential divider, wherein the first sub-potential divider and the second sub-potential divider have different impedance, and the brightness of the first color pixel unit and the third color pixel unit are controlled by the first sub-gamma voltage and the brightness of the second color pixel unit is controlled by the second sub-gamma voltage, respectively, when the first, second and third color pixel units are to be driven with a brightness corresponding to a low gray level and a middle gray level relative to the maximum gray level; and wherein the first potential divider and the second potential divider, including the first sub-potential divider and the second sub-potential divider, generate gamma voltages and sub-gamma voltages, respectively, having a same polarity.

2. A liquid crystal display device comprising:

a display panel comprising a first color pixel unit for generating a first primary color, a second color pixel unit for generating a second primary color and a third color pixel unit for generating a third primary color, wherein the first, second, and third primary colors are mutually different from each other, and the first, second and third pixel units are each coupled to a data electrode and different gate electrodes;

a gate driver outputting a plurality of scan signals to the corresponding gate electrodes; and a data driver outputting a video signal to the data electrode for controlling brightness of the first color pixel unit, the second color pixel unit and the third color pixel unit and comprising:

a first potential divider comprising a first plurality of resistors connected in series and coupled between a first node and a second node for receiving a reference voltage and generating a first main gamma voltage, wherein the brightness of the first color pixel unit, the second color pixel unit and the third color pixel unit are all controlled by the first main gamma voltage, when the first, second and third color pixel units are to be driven with a brightness corresponding to a high gray level relative to a maximum gray level; and at least one second potential divider coupled in series with the first potential divider between the second node and a third node for generating a first sub-gamma voltage and a second sub-gamma voltage, wherein the second potential divider comprises:

a first sub-potential divider comprising a second plurality of resistors connected in series, being coupled between the second node and the third node for generating the first sub-gamma voltage to both the first color pixel unit and the third color pixel unit; and a second sub-potential divider coupled in parallel with the first sub-potential divider between the second node and the third node for generating the second sub-gamma voltage to the second color pixel unit, the second sub-potential divider comprising:

a third plurality of resistors connected in series; and a switch coupled in series to the third plurality of resistors and controlled by a control signal for determining whether to activate the second sub-potential divider, wherein the first sub-potential divider and the second sub-potential divider have different impedance, and the brightness of the first color pixel unit and the third color pixel unit are controlled by the first sub-gamma voltage and the brightness of the second color pixel unit is controlled by the second sub-gamma voltage, respectively, when the first, second and third color pixel units are to be driven with a brightness corresponding to a low gray level and a middle gray level relative to the maximum gray level; and wherein the first potential divider and the second potential divider, including the first sub-potential divider and the second sub-potential divider, generate gamma voltages and sub-gamma voltages, respectively, having a same polarity.

3. A control method controlling a liquid crystal display device comprising a display panel comprising a first color pixel unit for generating a first primary color, a second color pixel unit for generating a second primary color and a third color pixel unit for generating a third primary color, wherein the first, second, and third primary colors are mutually different from each other, and a gamma voltage generator comprising a first potential divider comprising a first plurality of resistors connected in series and coupled between a first node and a second node for receiving a reference voltage and generating a first main gamma voltage and at least one second potential divider coupled in series with the first potential divider between the second node and a third node for generating a first sub-gamma voltage and a second sub-gamma voltage, wherein the second potential divider comprises:

a first sub-potential divider comprising a second plurality of resistors connected in series and coupled between the second node and the third node for generating the first sub-gamma voltage to both the first color pixel unit and the third color pixel unit and a second sub-potential divider coupled in parallel with the first sub-potential divider between the second node and the third node for generating the second sub-gamma voltage to the second color pixel unit, wherein the second sub-potential divider comprises: a third plurality of resistors connected in series and a switch coupled in series to the third plurality of resistors and controlled by a control signal for determining whether to activate the corresponding sub-potential divider, the control method comprising:

selecting a color pixel unit from the first color pixel unit, the second color pixel unit and third color pixel unit;

outputting the first main gamma voltage for controlling brightness of the selected color pixel unit when the selected pixel unit is to be driven with a brightness corresponding to a high gray level relative to a maximum gray level;

outputting the first sub-gamma voltage for controlling brightness of the selected pixel unit when the selected pixel unit is the first color pixel unit or the third color pixel unit and the first color pixel unit and the third color pixel unit are to be driven with a brightness corresponding to a low gray level and a middle gray level relative to the maximum gray level; and outputting the second sub-gamma voltage for controlling brightness of the selected pixel unit when the selected pixel unit is the second color pixel unit and the second color pixel unit is to be driven with a brightness corresponding to a low gray level and a middle gray level relative to the maximum gray level, wherein the first sub-potential divider and the second sub-potential divider have different impedance and wherein the first potential divider and the second potential divider, including the first sub-potential divider and the second sub-potential divider, generate gamma voltages and sub-gamma voltages, respectively, having a same polarity.

4. A gamma voltage generator controlling brightness of a first color pixel unit for generating a first primary color, a second color pixel unit for generating a second primary color and a third color pixel unit for generating a third primary color, wherein the first, second, and third primary colors are mutually different from each other, the gamma voltage generator comprising:

a first potential divider comprising a first plurality of resistors connected in series and coupled between a first node and a second node for receiving a reference voltage and generating a first main gamma voltage; and at least one second potential divider coupled in series with the first potential divider between the second node and a third node for generating a first sub-gamma voltage and a second sub-gamma voltage, wherein the second potential divider comprises:

a first sub-potential divider comprising a second plurality of resistors connected in series and coupled between the second node and the third node for generating the first sub-gamma voltage; and a second sub-potential divider coupled in parallel with the first sub-potential divider between the second node and the third node for generating the second sub-gamma voltage;

wherein the brightness of the first color pixel unit, the second color pixel unit and the third color pixel unit are all controlled by the first main gamma voltage when the first color pixel unit, the second color pixel unit and the third color pixel unit are to be driven with a brightness corresponding to a high gray level relative to a maximum gray level, and the brightness of the first color pixel unit and the third color pixel unit are controlled by the first sub-gamma voltage and the brightness of the second color pixel unit is controlled by the second sub-gamma voltage, respectively, when the first color pixel unit, the second color pixel unit and the third color pixel unit are to be driven with a brightness corresponding to a low gray level and a middle gray level relative to the maximum gray level; and wherein the second sub-potential divider comprises:

a third plurality of resistors connected in series; and a switch coupled in series to the third plurality of resistors and controlled by a control signal for determining whether to activate the corresponding sub-potential divider; and wherein the first sub-potential divider and the second sub-potential divider have different impedance and wherein the first potential divider and the second potential divider, including the first sub-potential divider and the second sub-potential divider, generate gamma voltages and sub-gamma voltages, respectively, having a same polarity.

* * * * *